United States Patent [19]

Fournier

[11] 4,339,893

[45] Jul. 20, 1982

[54] QUICK RELEASE HUB ASSEMBLY

[75] Inventor: Roger H. Fournier, Millbury, Mass.

[73] Assignee: The Warner & Swasey Company, Cleveland, Ohio

[21] Appl. No.: 195,413

[22] Filed: Oct. 9, 1980

[51] Int. Cl.[3] ..... B24B 41/00; B24B 45/00

[52] U.S. Cl. ..... 51/168; 409/234; 83/676; 83/666

[58] Field of Search ..... 51/168, 209 R; 83/651, 83/663, 665, 666, 676, 481; 409/231, 232, 234, 236

[56] References Cited

U.S. PATENT DOCUMENTS

| | | | |
|---|---|---|---|
| 922,049 | 5/1909 | Sanfason | 51/168 |
| 1,193,525 | 8/1916 | Dosch | 51/168 |
| 2,616,230 | 11/1952 | Hough | 51/168 |
| 2,747,343 | 5/1956 | Gellert | 51/168 |
| 2,815,077 | 12/1957 | Pechy | 83/481 |
| 3,440,915 | 4/1969 | Weyant | 83/676 |
| 3,728,827 | 4/1973 | Koppenwallner | 51/168 |
| 3,967,415 | 7/1976 | Seckinger et al. | 51/168 |
| 4,251,955 | 2/1981 | Shawke | 51/168 |

FOREIGN PATENT DOCUMENTS

| | | | |
|---|---|---|---|
| 1137066 | 1/1957 | France | 51/168 |

*Primary Examiner*—Roscoe V. Parker
*Attorney, Agent, or Firm*—Yount & Tarolli

[57] ABSTRACT

An improved hub assembly is utilized to rotatably mount a grinding wheel. The hub assembly includes a hub which engages a first major side surface of the grinding wheel. A circular clamp member is mounted on the hub by a plurality of fasteners. An annular flange ring circumscribes the clamp member and engages a second major side surface of the grinding wheel. The clamp member has radially extending arms which engage the flange ring and press it against the grinding wheel. A cover is mounted on the flange ring and extends over the fasteners. When the grinding wheel is to be removed from the hub assembly, the fasteners are loosened by inserting a suitable tool though openings in the cover. Loosening the fasteners enables the annular flange ring to be rotated relative to the clamp member until the radially extending arms on the clamp member are aligned with radially extending recesses formed inside the flange ring. The flange ring can then be moved axially outwardly away from the grinding wheel and the clamp member.

5 Claims, 10 Drawing Figures

QUICK RELEASE HUB ASSEMBLY

BACKGROUND OF THE INVENTION

The present invention relates generally to a grinding machine and more specifically to a grinding wheel mounting assembly.

In grinding machines, such as crankshaft grinders and camshaft grinders, a grinding wheel is rotated and brought into contact with a workpiece to perform a grinding operation. In time, the grinding wheel may become worn and replacement necessary. Because the time required to replace the grinding wheel results in lost production, attempts have been made to provide a grinding wheel mounting assembly which is quickly and easily released.

Known grinding wheel mounting arrangements are disclosed in U.S. Pat. Nos. 922,049; 1,193,525; 2,616,230; 2,747,343; 3,728,827; and 3,967,415. A known grinding wheel hub mounting arrangement is also disclosed in French Pat. No. 1,137,066.

BRIEF SUMMARY OF THE INVENTION

The present invention relates to an improved hub assembly which is quickly and easily released to enable a worn grinding wheel to be removed and a new grinding wheel mounted on the hub assembly. The hub assembly includes a hub which is adapted to be mounted on a driven shaft. The hub is provided with a side surface which abuttingly engages a major side surface of the grinding wheel.

The grinding wheel is held in place by a clamp member and a flange ring. The clamp member presses the flange ring against a major side surface of the grinding wheel. When the grinding wheel is to be removed from the hub assembly, fasteners are loosened and the flange ring is moved relative to the clamp member until arms on the clamp member are aligned with recesses formed in the flange ring. The flange ring can then be moved outwardly away from the grinding wheel.

A cover is mounted on the flange ring and extends across the ends of the fasteners. When the fasteners are to be loosened, a tool is inserted through openings in the cover. When the flange ring is moved outwardly away from the grinding wheel, the cover moves along with the flange ring.

Accordingly, it is an object of the present invention to provide a new and improved hub assembly which rotatably mounts a grinding wheel and enables a worn grinding wheel to quickly and easily removed and a new grinding wheel installed in its place.

Another object of this invention is to provide a new and improved hub assembly in accordance with the next preceding object and wherein a clamp member has arms which press a flange ring against a major side surface of the grinding wheel, the flange ring being movable relative to the clamp member to align the arms on the clamp member with recesses in the flange ring so that the flange ring can be moved away from the grinding wheel.

BRIEF DESCRIPTION OF THE DRAWINGS

The foregoing and other objects and features of the present invention will become more apparent upon a consideration of the following description taken in connection with the accompanying drawings wherein.

DESCRIPTION OF ONE SPECIFIC PREFERRED EMBODIMENT OF THE INVENTION

Figure 1:
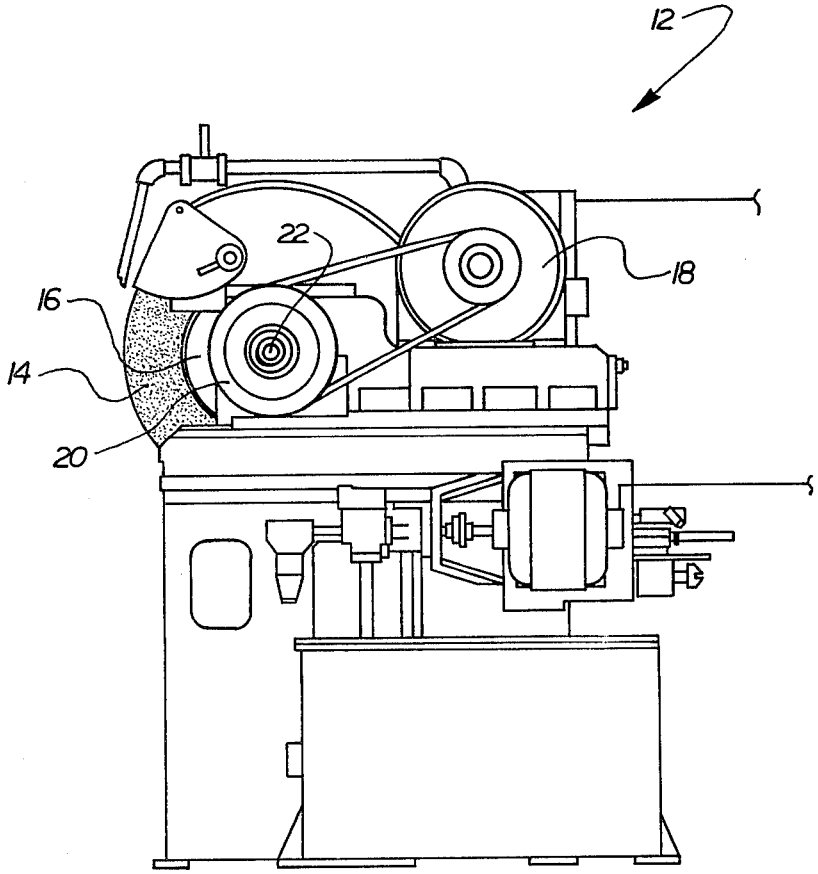
FIG. 1 is an elevational side view of a grinding machine having a hub assembly constructed in accordance with the present invention.

A grinding machine 12 is illustrated in FIG. 1 and has an annular grinding wheel 14 which is rotatably mounted on a hub assembly 16 constructed in accordance with the present invention. The grinding machine 12 includes a grinding wheel drive motor 18 which drives a pulley 20. The pulley 20 is fixedly mounted on a drive shaft 22 which extends into the hub assembly 16.

The hub assembly 16 includes a one piece circular hub 26 (FIG. 2) which is rotated about its central axis 28 by the drive shaft 22. The drive shaft 22 is telescopically received in a central opening 30 formed in the hub 26 and is fixedly connected with the hub. Therefore, rotation of the drive shaft 22 by the motor 18 rotates the hub 26 about the axis 28.

Figure 6:
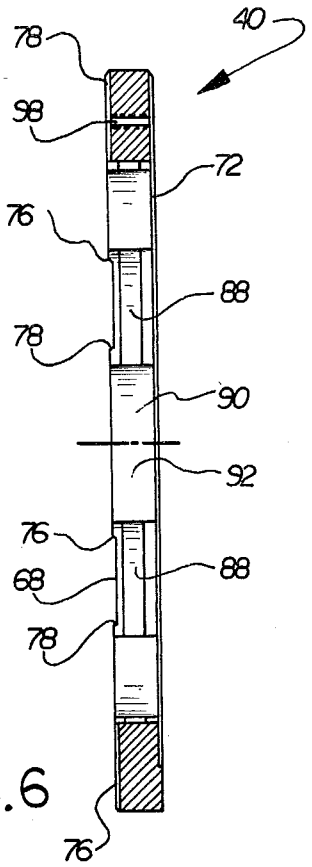
FIG. 6 is a sectional view, taken generally along the line 6—6 of FIG. 5, further illustrating the construction of the flange ring.

A clamp assembly 34 is provided to hold the grinding wheel 14 in place on the hub 26 as the hub is rotated by the drive shaft 22. The clamp assembly 34 includes a circular clamp member or ring 38 (see FIGS. 2, 7 and 8) which is coaxial with the hub 26. The clamp member 38 presses an annular flange member or ring 40 (see FIGS. 2, 5 and 6) against an outer major side surface 42 of the grinding wheel 14. The flange ring 40 is disposed in a coaxial relationship with the clamp member 38 and grinding wheel 14. A cover 46 is mounted on the flange ring 40 and extends across fastener elements or bolts 48 which mount the clamp member 38 on the hub 26. Although only one fastener element 48 has been shown in FIG. 2, it should be understood that a plurality of bolts 48 are provided and extend through untapped holes or openings 52 (FIG. 7) disposed in a circular array about the clamp member 38. Threaded end portions of the bolts 48 are received in threaded openings in the hub 26.

During operation of the grinding machine 12, the hub assembly 16 firmly grips the grinding wheel 14 to hold it against rotation and axial movement relative to the drive shaft 22. Thus, a radially outwardly projecting annular outer side surface 56 (FIG. 2) on the hub 26 is disposed in abutting engagement with a flat annular major side surface 58 on the grinding wheel 14. A cylindrical inner side surface 60 of the grinding wheel 14 is disposed in abutting engagement with a cylindrical axially extending shoulder 62 on the hub 26.

Figure 2:
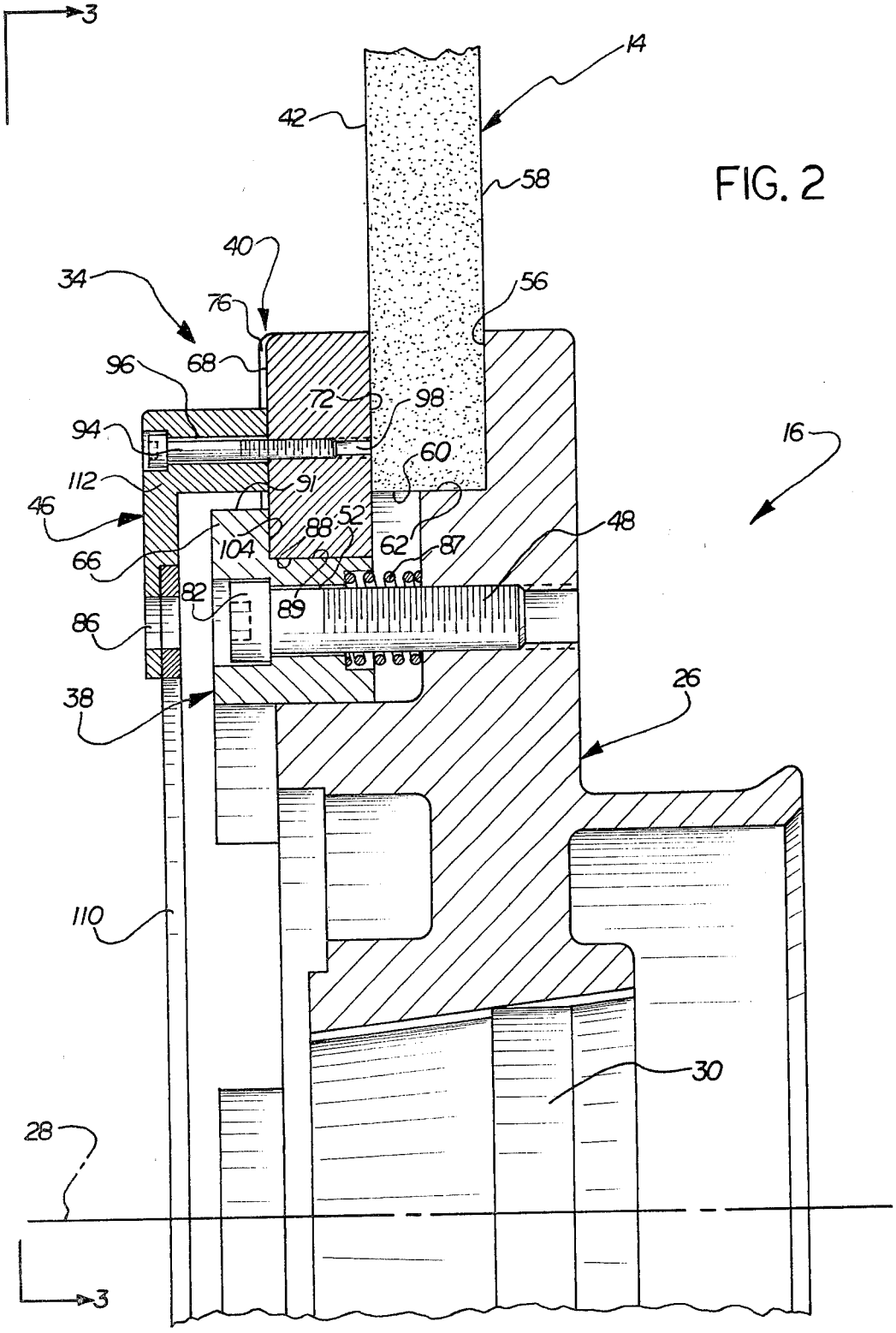
FIG. 2 is an enlarged fragmentary sectional view of the hub assembly of FIG. 1, the hub assembly being shown apart from the grinding machine for purposes of clarity of illustration.

In order to firmly grip the grinding wheel 14, radially extending arms 66 on the annular clamp member 38 (see FIGS. 2, 7 and 8) apply an axially inwardly, that is toward the right as viewed in FIG. 2, force against radially extending clamp surfaces 68 on the flange ring 40. The axially inwardly directed force applied against the flange ring 40 by the clamp member 38 presses a flat annular major side surface 72 on the flange ring against the annular major outer side surface 42 of the grinding wheel. The side surface 72 on the flange ring 40 extends parallel to the side surface 56 on the hub 26. Therefore, the grinding wheel 14 is clamped between the flange ring 40 and the hub 26.

Figure 3:
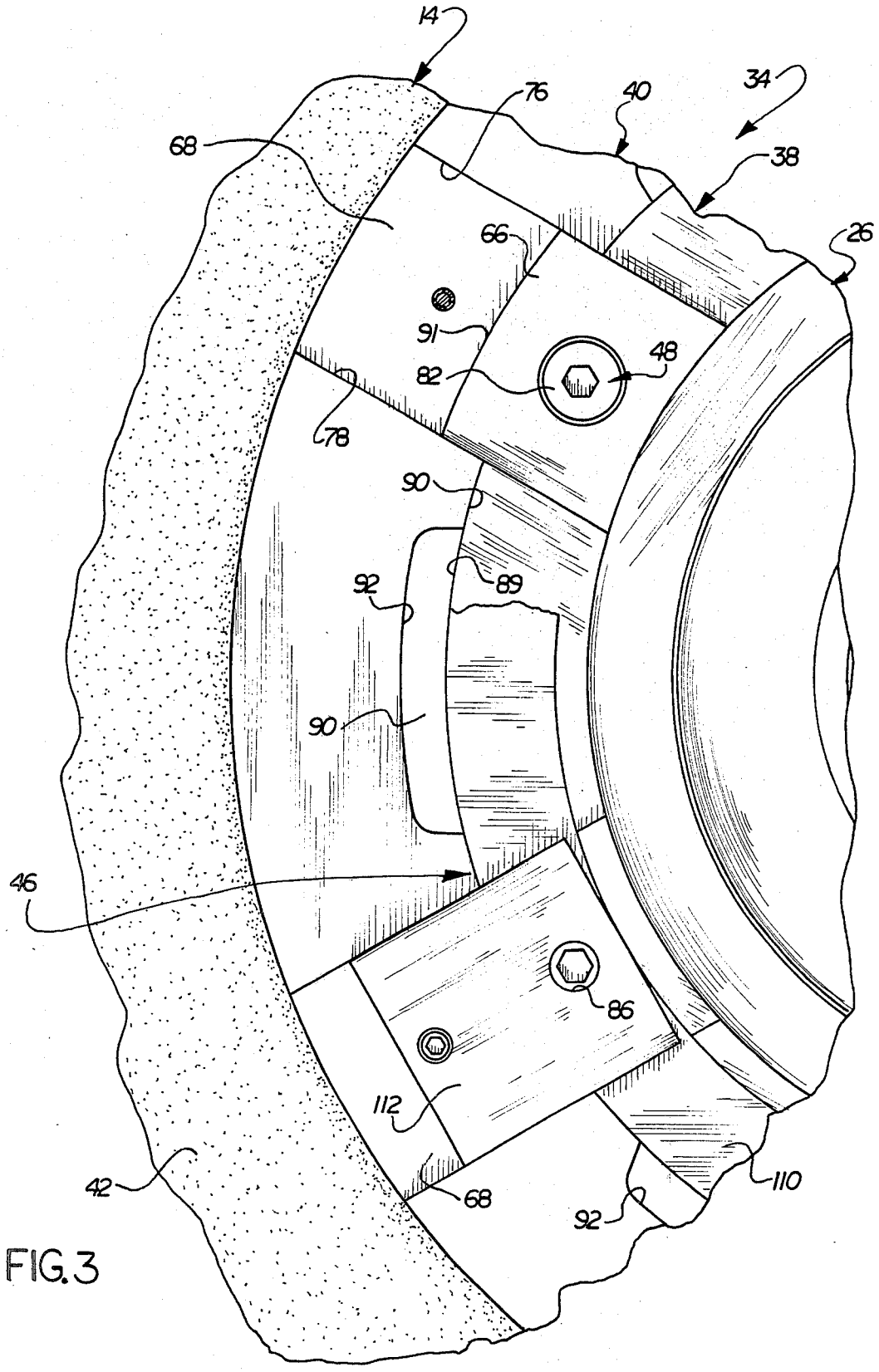
FIG. 3 is a fragmentary plan view, taken generally along the line 3—3 of FIG. 2, depicting the relationship between a circular clamp member and an annular flange ring which circumscribes the clamp member, the flange ring being illustrated in a retaining position in which a grinding wheel is held in place on the hub assembly.
Figure 7:
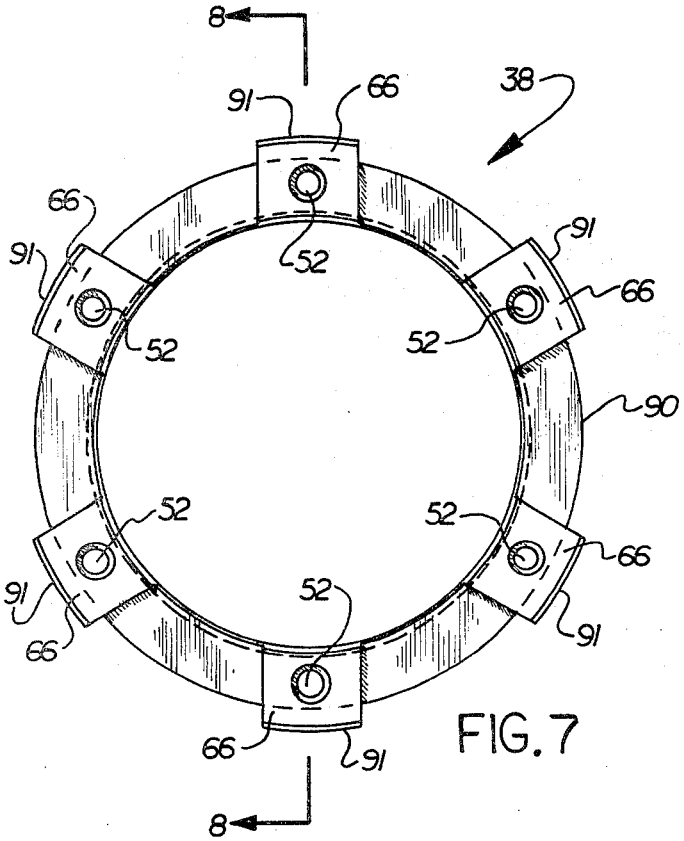
FIG. 7 is a plan view of the clamp member.

During operation of the grinding machine 12, it is contemplated that the flange ring 40 will be subjected to forces which will tend to rotate it relative to the hub 26. In order to hold the flange ring 40 against rotation relative to the hub 26, the clamp surfaces 68 (see FIGS. 5 and 6) are recessed so that parallel shoulders or side surfaces 76 and 78 on opposite sides of the clamp surfaces 68 engage opposite sides of the radially extending arms 66 of the clamp member 38 (FIGS. 3 and 7). Abutting engagement between the clamp arms 66 and side surfaces 76 and 78 of the recesses 68 hold the clamp member 38 and flange ring 40 against rotation relative to each other.

The fasteners 48 (FIG. 2) perform the dual functions of holding the clamp member 38 against rotation relative to the hub 26 and of applying an axially directed force to the clamp member 38 to press the clamp member against the flange member 40. The annular cover 46 extends across the head end portions 82 of the fasteners 48 so that particles from a workpiece do not accumulate around the fasteners and to protect them during operation of the grinding machine 12. Of course, the amount of clamping force applied against the opposite side surfaces 42 and 58 of the grinding wheel 14 can be adjusted by adjusting the extent to which the fasteners 48 are tightened into the hub 26.

After the grinding wheel 14 has been used for an extended period of time, it is contemplated that it may be necessary to replace the grinding wheel. When this is to be done, the drive motor 18 is stopped so that the hub 26 is no longer rotated by the drive shaft 22. The clamp assembly 34 (see FIG. 2) is then loosened by inserting a suitable tool through circular openings 86 formed in the cover 46. The tool engages a socket in the head end portion 82 of each of the fasteners 48 and is rotated to loosen the fastener.

Loosening the fasteners 48 enables the annular clamp ring 38 to move axially outwardly under the influence of biasing springs 87. The clamp arms 66 move axially out of engagement with the recessed clamp surfaces 68 on the flange ring 40. Once the clamp member 38 has been moved axially outwardly (towards the left as viewed in FIG. 2) for a sufficient distance to clear the side surfaces 76 and 78, the flange ring 40 is free to rotate relative to the grinding wheel 14, the clamp member 38 and the hub 26.

Figure 4:
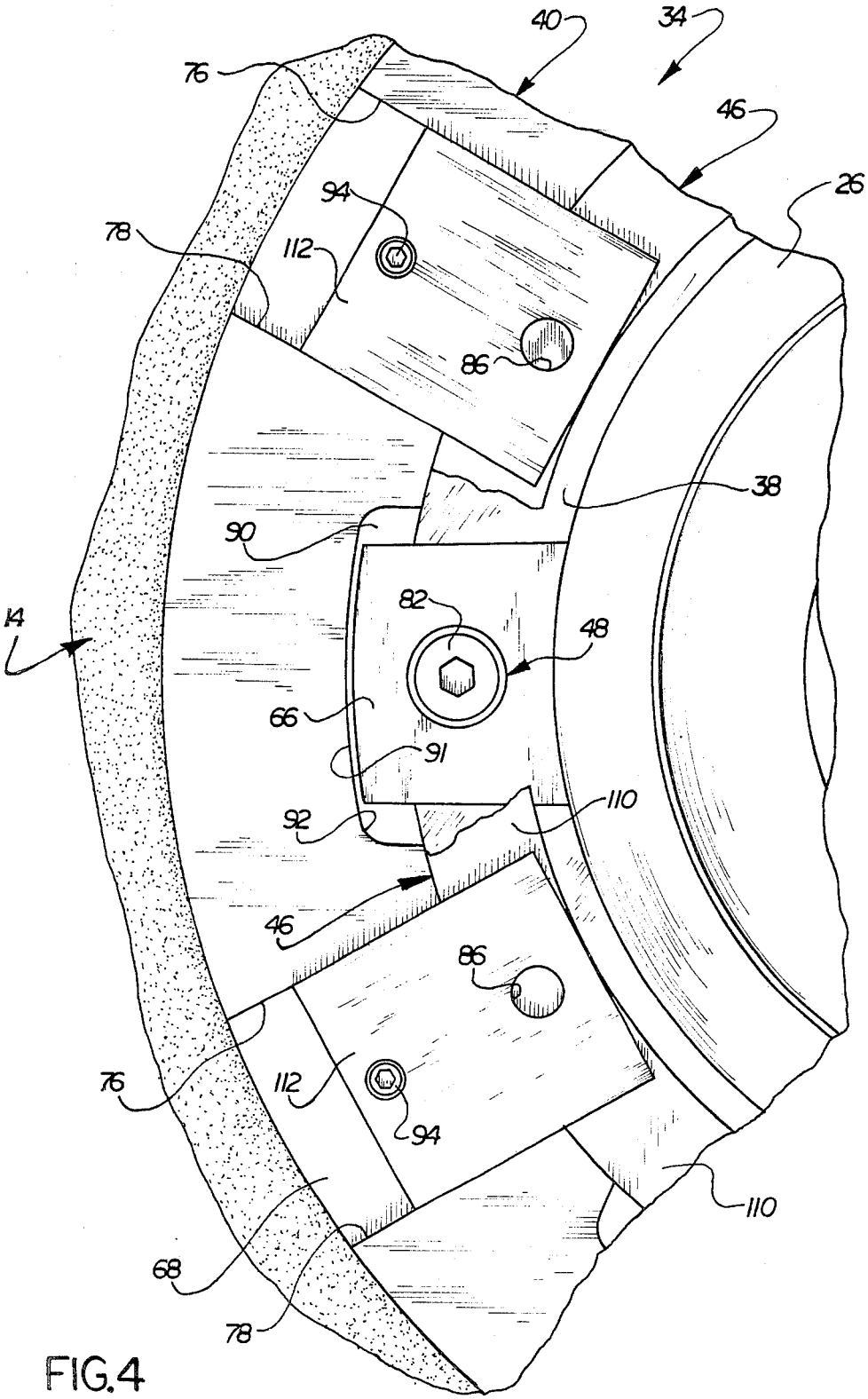
FIG. 4 is a fragmentary plan view, generally similar to FIG. 3, illustrating the relationship between the flange ring and clamp member when the flange ring has been moved to a release position to enable the grinding wheel to be removed from the hub assembly.
Figure 8:
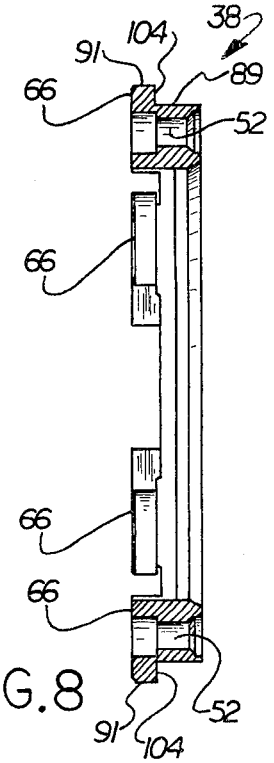
FIG. 8 is a sectional view, taken generally along the line 8—8 of FIG. 7, further illustrating the construction of the clamp member.

The flange ring 40 is then rotated relative to the clamp member 38 from the engaged or retaining position of FIG. 3 to the disengaged or released position of FIG. 4. As this occurs, a circular array of radially extending recesses 90 on the flange ring 40 move into axial alignment with the arms 66 on the clamp member 38. During relative rotation between the coaxial flange ring 40 and clamp member 38, the clamp member is held against rotation relative to the hub 26 by the fastener elements 48. As the flange ring 40 is rotated relative to the clamp member 38, arcuate surfaces 88 (FIG. 5) on the flange ring 40 slide along a cylindrical support surface 89 on the clamp member 38 (FIGS. 7 and 8).

Figure 5:
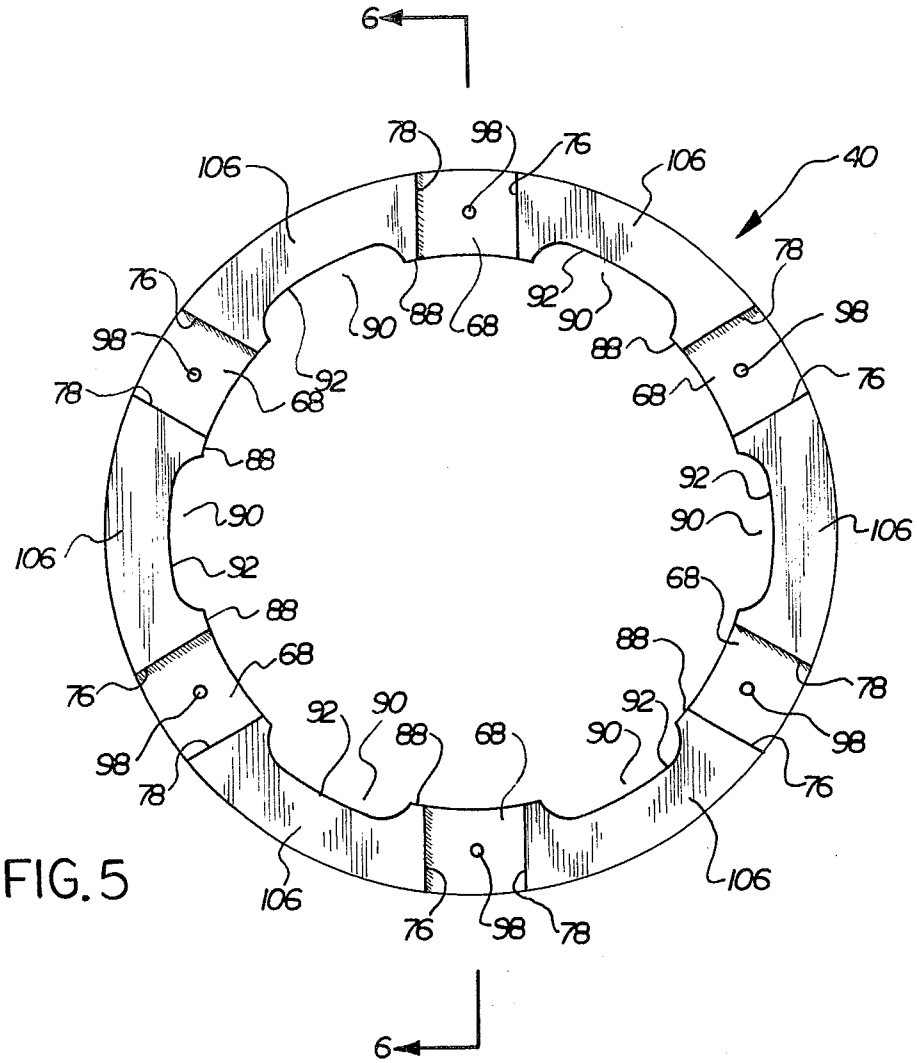
FIG. 5 is a plan view of the flange ring.

Once the recesses 90 in the annular flange ring 40 have been moved into radial alignment with the clamp arms 66 in the manner shown in FIG. 4, the flange ring 40 can be moved axially outwardly, that is toward the left, from the position shown in FIG. 2. As the flange ring 40 is moved axially outwardly, the radially projecting clamp arms 66 pass through the radially extending openings 90 in the flange ring. Thus, the clamp arms 66 have arcuate outer end surfaces 91 (FIG. 7) which are disposed in a circular array having a smaller diameter than a circular array of arcuate radially outer bottom surfaces 92 of the recesses 90 (FIG. 5). The cover 46 is mounted on the flange ring 40 by suitable fasteners 94 (FIG. 2) which extend through untapped openings 96 into threaded openings 98 formed in the flange ring 40 (see FIG. 5).

After the flange ring 40 and cover 46 have been moved away from the hub 26, the grinding wheel 14 can be moved axially off the hub. It should be noted that the inside diameter of the annular grinding wheel 14 is sufficient to clear the radially projecting arms 66 on the clamp member 38 without interference. Therefore, the grinding wheel can be removed without completely loosening the fasteners 48 to disengage the clamp member 38 from the hub 26.

A new grinding wheel 14 is then mounted on the hub 26 in place of the worn grinding wheel. After the new grinding wheel has been moved into place on the hub 26, the flange ring is moved into engagement with the grinding wheel. To accomplish this, the flange ring 40 is axially aligned with the hub 26 and the recesses 90 (FIG. 5) in the flange ring are aligned with the radially projecting arms 66 (FIG. 7) on the clamp member 38. The flange ring 40 is then moved inwardly toward the grinding wheel 14 and the arms 66 again pass through the recesses 90. At this time, the orientation of the flange ring 40 relative to the clamp ring 38 will be the same as is shown in FIG. 4.

Once the flat axially inner side surface 72 on the flange ring 40 has been moved into abutting engagement with the flat annular major side surface 42 of the new grinding wheel 14, the flange member 40 is rotated relative to the clamp member 38 from the release position of FIG. 4 to the engaged position of FIG. 3. As this occurs, radially outwardly extending inner side surfaces 104 on the clamp arms 66 (see FIGS. 2 and 8) are slidingly engaged by flat axially outward side surfaces 106 (see FIG. 5) on the flange ring 40. When the clamp surfaces 68 on the flange ring 40 have been moved into alignment with the radially projecting arms 66 on the clamp member 38, a tool is again inserted through the openings 86 in the cover 46 to tighten the fasteners 48. The fasteners 48 are tightened with sufficient force to firmly grip the grinding wheel 14 between the flange ring 40 and the hub 26. It should be noted that since the fasteners 48 do not have to be disengaged from the hub 26 and since the flange ring 40 merely has to be telescoped over the clamp member 38 and rotated through a relatively small distance to engage the clamp assembly 34, the time required to replace a worn grinding wheel 14 tends to be minimized.

Figure 9:
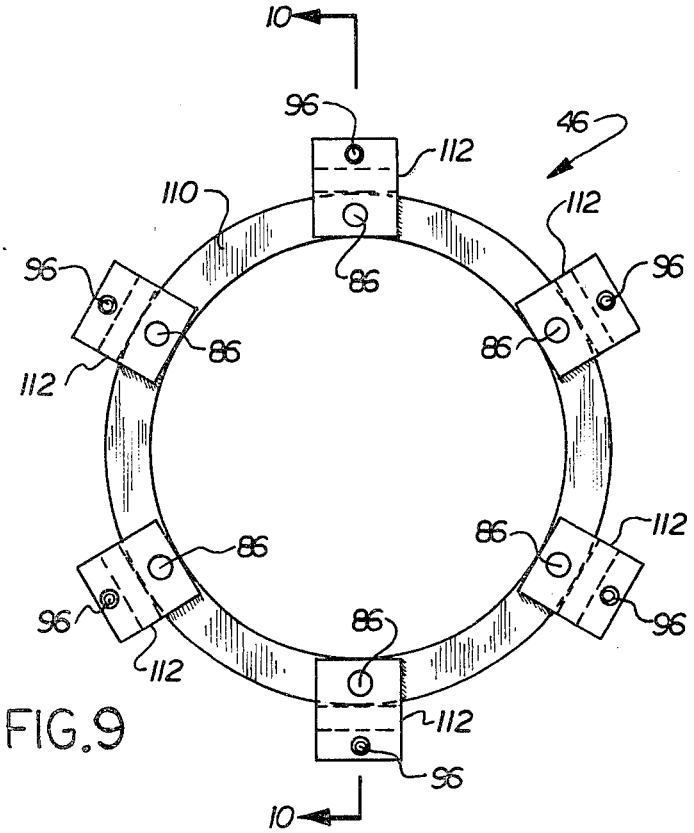
FIG. 9 is a plan view illustrating the construction of a cover member.
Figure 10:
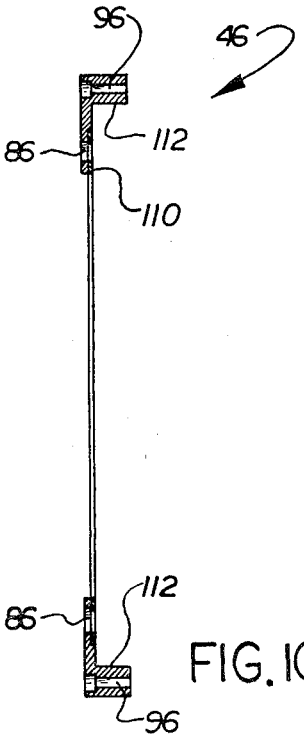
FIG. 10 is a sectional view, taken generally along the line 10—10 of FIG. 9, further illustrating the construction of the cover member.

The cover 46 includes an annular ring or body 110 which extends across the circular array of fastener elements 48 (see FIGS. 2, 9 and 10). A plurality of radially and axially projecting mounting sections or legs 112 are fixedly connected to the annular ring or body 110 and have openings 96 through which the fasteners 94 extend to fixedly secure the cover in a coaxial relationship with the flange ring 40. It should be noted that the legs 96 are sized so as to have substantially the same width as the arms 66 on the clamp member 38 so that the legs are received between the radially outwardly extending side surfaces 76 and 78 on the flange ring 40 (see FIG. 4).

In view of the foregoing it is apparent that the present invention relates to an improved hub assembly 16 which is quickly and easily released to enable a worn grinding wheel 14 to be removed from the hub assembly and subsequently engaged to hold a new grinding wheel in place on the hub assembly. The hub assembly 16 includes a hub 26 which is adapted to be mounted on a driven shaft 22. The hub 26 is provided with a side surface 56 which abuttingly engages a major side surface 58 of the grinding wheel 14.

The grinding wheel 14 is held in place by a clamp member 38 and a flange ring 40. The clamp member 38 presses the flange ring 40 against a major side surface 42 of the grinding wheel. When the grinding wheel 14 is to be removed from the hub assembly 16, fastener elements 48 are loosened and the flange ring 40 is moved relative to the clamp member 38 until arms 66 on the clamp member are aligned with recesses 90 formed in the flange ring. The flange ring 40 can then be moved outwardly away from the grinding wheel.

A cover 46 is mounted on the flange ring 40 and extends across the ends of the fastener elements 48. When the fastener elements 48 are to be loosened, a tool is inserted through openings 86 in the cover. When the flange ring 40 is moved outwardly away from the grinding wheel, the cover moves along with the flange ring.

Having described one specific preferred embodiment of the invention, the following is claimed:

1. A hub assembly for rotatably mounting a grinding wheel having a pair of major side surfaces, said assembly comprising a rotatable hub having surface means for engaging a first major side surface of the grinding wheel, a circular clamp member disposed in a coaxial relationship with said hub, said clamp member having a plurality of radially outwardly projecting arms, fastener means for connecting said clamp member with said hub and for holding said clamp member against rotation relative to said hub, an annular flange ring circumscribing and disposed in a coaxial relationship with said clamp member, said flange ring including first surface means which defines a plurality of recesses which extend radially outwardly from a central opening in said flange ring for a distance sufficient to enable said flange ring to be moved axially outwardly from said clamp member when said arms are aligned with said recesess, said flange ring including second surface means which defines a plurality of clamp surfaces which are disposed on a radially extending and axially outer side portion of said flange ring and are disposed between adjacent recesses in said flange ring, said flange ring including third surface means for defining a radially extending and axially inner side portion of said flange ring which is adapted to engage a second major side surface of the grinding wheel, said flange ring being rotatable relative to said hub and clamp member between a retaining position and a release position, said radially extending arms on said clamp member being disposed in abutting engagement with said clamp surfaces and said fastener means being effective to press said clamp member against said flange ring to thereby press said third surface means against the second major side surface of the grinding wheel when said flange ring is in the retaining position, said radially extending arms on said clamp member being disposed in alignment with the recesses in said flange ring when said flange ring is in the release position to thereby enable said flange ring to be moved axially outwardly from the grinding wheel.

2. A hub assembly as set forth in claim 1 further including a cover fixedly mounted on said flange ring, said cover including a circular body and mounting means extending between said body and said flange ring for supporting said body in a coaxial relationship with said clamp member and flange ring at a location disposed axially outwardly of said clamp member.

3. A hub assembly as set forth in claim 2 wherein said fastener means includes a plurality of releasable fastener elements disposed in an array on said clamp member, said cover including means for defining a plurality of openings each of which is disposed in axial alignment with one of said fastener elements to provide access to said fastener elements.

4. A hub assembly as set forth in claim 1 wherein said clamp surfaces are recessed in the radially extending and axially outer side portion of said flange ring and have a width which corresponds to the width of the radially extending arms on said clamp member to hold said flange ring against rotation relative to said clamp member when said flange ring is in the retaining position.

5. A hub assembly as set forth in claim 1 wherein said flange ring includes a plurality of arcuate inner side surfaces which are disposed in a circular array and are separated by said recesses, said clamp member including a circular outer side surface which is engaged by said arcuate inner side surfaces of said flange ring to support said flange ring for rotation relative to said clamp member.

* * * * *